United States Patent [19]

Ishiguro et al.

[11] Patent Number: 4,931,422

[45] Date of Patent: Jun. 5, 1990

[54] NO-CARBON PRESSURE-SENSITIVE COPYING PAPER

[75] Inventors: Mamoru Ishiguro, Tokyo; Akira Kawai, Takasago, both of Japan

[73] Assignee: Mitsubishi Paper Mills Limited, Tokyo, Japan

[21] Appl. No.: 233,002

[22] Filed: Aug. 17, 1988

[30] Foreign Application Priority Data

Aug. 19, 1987 [JP] Japan ..... 62-207322
Jun. 18, 1988 [JP] Japan ..... 63-151023

[51] Int. Cl.[5] ..... B41M 5/16

[52] U.S. Cl. ..... 503/214; 428/514; 428/914; 503/215

[58] Field of Search ..... 427/150–152; 503/214, 225, 215; 428/514, 914

[56] References Cited

FOREIGN PATENT DOCUMENTS 61-268481 11/1986 Japan ..... 503/214
61-273985 12/1986 Japan ..... 503/214
61-280985 12/1986 Japan ..... 503/214
2087942 6/1982 United Kingdom ..... 503/214

*Primary Examiner*—Bruce H. Hess
*Attorney, Agent, or Firm*—Cushman, Darby & Cushman

[57] ABSTRACT

A no-carbon pressure-sensitive copying paper obtained by coating a composition containing an alkali thickening type copolymer latex as a binder on a support is excellent in color forming properties, resistance to smudge and high concentration coating suitability.

6 Claims, No Drawings

NO-CARBON PRESSURE-SENSITIVE COPYING PAPER

BACKGROUND OF THE INVENTION

This invention relates to a no-carbon pressure-sensitive copying paper having a microcapsule coating layer obtained by using a special binder and being excellent in color developing properties, resistance to smudges and high concentration coating suitability.

No-carbon pressure-sensitive copying paper is usually produced by coating micro-capsules containing colorless leuco dyes in several microns to ten-odd microns in diameter on a support. Sometimes, the micro-capsules and a color developer are coated on supports separately and used as a top sheet and a bottom sheet, or alternatively the micro-capsules and the color developer are coated on both sides of a support and used as an intermediate sheet. When a plurality of these sheets are piled with a proper combination and a physical pressure is applied thereto by handwriting, typewriting, or the like to rupture the micro-capsules, the leuco dye in the micro-capsules is in contact with a developer to form a color, which results in giving a recorded image.

Major conditions generally required for producing no-carbon pressure-sensitive copying papers and quality thereof are as follows:

(1) A dense and clear image can be obtained in a short time and not deteriorated with the lapse of time.

(2) When color development is not desired, for example, during the production process of no-carbon pressure-sensitive paper, during printing and cutting steps, or during storage or handling in the form of sheets or wind-up state, there take place no smudges.

Since the above-mentioned two requirements are contradictory, it is difficult to satisfy the both requirements sufficiently at the same time. But the improvement therefor has been tried and proposed, for example, by changing production conditions of micro-capsules, changing the kind and amount of buffering agents, changing the kind and amount of binders. No satisfactory results are obtained.

On the other hand, in the production of not only pressure-sensitive copying paper but also coated paper, the concentration of coating solutions is tried to be made higher in order to lower the energy necessary for drying the coated paper to the utmost and to increase the coating speed. As a means for attaining such objects, there have been proposed an improvement in properties of coating solutions, an improved process for coating, or the like. Particularly, in the production of pressure-sensitive copying paper, there have been proposed a process for using a low viscosity microcapsule emulsion, a process for using a low viscosity binder, a process for scraping a coating solution, and the like. For example, the use of a latex as a binder is shown in Japanese Patent Unexamined Publication Nos. 61- 268481, 61-273985, and 61-280985. But resistance to smudge due to friction is still insufficient. Even combining the above-mentioned means to carry out high concentration coating, the resulting pressure-sensitive copying paper is lowered in resistance to smudge due to friction in practical use. This results in greatly damaging the quality of no-carbon pressure-sensitive copying paper.

As mentioned above, the quality of no-carbon pressure-sensitive copying paper is greatly influenced by not only formulation of coating solutions but also coating methods and coating solution concentrations. No no-carbon pressure-sensitive copying paper improved in the above-mentioned defects has been obtained.

SUMMARY OF THE INVENTION

It is an object of this invention to provide a no-carbon pressure-sensitive copying paper overcoming the problems mentioned above on the quality and production thereof.

This invention provides a no-carbon pressure-sensitive copying paper comprising a support and coated thereon a coating composition comprising (a) micro-capsules including one or more color forming agents therein, (b) a buffering agent, and (c) a binder, said binder being an alkali thickening type copolymer latex.

DESCRIPTION OF THE PREFERRED EMBODIMENTS

The no-carbon pressure-sensitive copying paper of the present invention has the following advantages:

(i) Color forming sensitivity is raised. Even a large number of sheets are copied, clear images can be obtained.

(ii) Smudges can be prevented when no color forming is intended. Smudges are caused, for example, by dynamic friction generated by rubbing, by static pressure applied during storage in a wind-up state, during printing or during guillotine cutting, or by rupture of micro-capsules when allowed to stand in heated and/or moistured state for a long period of time. In each case, excellent resistance to smudge can be obtained.

(iii) High concentration coating suitability is improved. That is, it is possible to use a low scraping pressure. More concretely, it is possible to easily scrape a coating solution by using an air knife coater with a low blowoff pressure. Further, lowering in properties can be minimized.

The above-mentioned advantages can be obtained by using an alkali thickening type copolymer latex.

The alkali thickening type copolymer latex means a copolymer latex which maintains dispersing properties at an acidic side, while dissolves with an increase of the pH of the system (at alkaline side), to increase the viscosity of the system. Such a property is very special from a usual concept of copolymer latex.

The alkali thickening type copolymer latex can be produced, for example, by copolymerization using a large amount of an unsaturated carboxylic acid as a monomer component. By addition of an alkali, the carboxyl group is neutralized and released to make latex particles soluble in the aqueous medium or swelled to increase the viscosity of the system. (Usual latices do not increase their viscosities, even if an alkali is added thereto.)

Examples of the alkali thickening type copolymer latex are an alkali thickening type styrene-butadiene copolymer latex (hereinafter referred to as "SB copolymer latex."), an alkali thickening type acrylonitrile-butadiene copolymer latex, an alkali thickening type methyl methacrylate-butadiene copolymer latex, an alkali thickening type acrylic ester copolymer latex, and the like. These latices can be used alone or as a mixture thereof.

The copolymer latex used in the present invention preferably has a Brookfield viscosity of 50 to 10000 cps, more preferably 100 to 6000 cps, measured at a solid content of 30% by weight, pH 8.0 and 20° C. When the Brookfield viscosity is too low, the resistance to smudge is lowered like the case of using a usual non-thickening type copolymer latex. On the other hand, when the viscosity is too high, the high concentration coating suitability is undesirably damaged.

The glass transition temperature (Tg) of the copolymer used in the copolymer latex also influences quality of the resulting pressure-sensitive copying paper considerably. Thus, it also becomes important to control Tg of a copolymer used in the copolymer latex.

The Tg means a critical temperature at which a polymeric material changes from a glass-like solid state to a rubber-like elastic state when heated, and an important property as an index for showing hardness of a film formed by coating and drying. In the present invention, the Tg of copolymer used in the copolymer latex influences greatly on resistance to smudge due to dynamic friction and resistance to smudge due to static pressure. In order to make both resistances good, it is desirable to make the Tg −30° C. to 10° C. When the Tg is too low, the resistance to smudge due to dynamic friction is undesirably lowered, while when the Tg is too high, the resistance to smudge due to static pressure increases undesirably.

The copolymer latex mentioned above can easily be produced by a conventional method, and can also be available commercially (e.g. Nipole LX 860, a trade name, mfd. by The Japanese Geon Co., Ltd., etc.).

It is desirable to use the copolymer latex in an amount of 3 to 40 parts by weight, more preferably 5 to 30 parts by weight, on solid basis per 100 parts by weight of the micro-capsules. When the amount of the copolymer latex is lower than 3 parts by weight, the adhesive strength of the composition to the support becomes insufficient and the resistance to smudge is undesirably lowered. On the other hand, when the amount of the copolymer latex is too large, the color forming sensitivity is lowered or setting becomes poor when a book is made by using a plurality of sheets of the no-carbon pressure-sensitive copying paper.

The composition for coating the no-carbon pressure-sensitive copying paper used in the present invention comprises micro-capsules including one or more color forming agents therein, (b) a buffering agent, and (c) a binder, that is, the special copolymer latex mentioned above.

The micro-capsules including color forming agents can be prepared by conventional processes such as a coacervation method using gelatin-gum arabic ion complex, an interfacial polymerization method wherein insoluble films are formed at an inteface of a hydrophilic liquid which becomes a dispersing medium and a hydrophobic liquid which is to be encapsulated, an in situ polymerization method wherein a melamine-formaldehyde resin, a urea-formaldehyde resin or the like precondensate for forming films is added to a side of hydrophilic liquid which becomes a dispersing medium, followed by resinification to form micro-capsules, etc. Among the above-mentioned encapsulation processes, the interfacial polymerization method and the in situ polymerization method are preferable, since according to the coacervation method, films of micro-capsules are often broken in a copolymer latex.

The buffering agent is added to prevent the micro-capsules from break. Examples of the buffering agent are wheat starch, potato starch, cellulose fine powder, synthetic plastic pigments, and the like. The buffering agent is used preferably in an amount of 10 to 100 parts by weight per 100 parts by weight of the micro-capsules.

In addition to the copolymer latex, there can be used as a binder a water-soluble polymeric material such as soluble starch, casein, gelatin, gum arabic, polyvinyl alcohol, methyl cellulose, etc., and various kinds of latices such as a vinyl acetate latex, an acrylic latex, etc. so long as the effect of the present invention is not damaged.

The coating composition comprising the micro-capsules, the copolymer latex, the buffering agent, water, etc., used in the present invention has preferably a pH of 7 to 12, a solid content of 15 to 40% by weight and a Brookfield viscosity of 10 to 100 cps measured at a solid content of 20% by weight and 20° C. The viscosity and the solid content can be controlled depending on the coating method employed.

The coating composition, if required, may contain one or more liquid property adjusting agents (viscosity, pH, etc.), antifoaming agents, various activating agents, waxes, lubricants, and the like additives conventionally used in this art.

The coating composition comprising micro-capsules and the like is coated on one side of a support to give a pressure-sensitive copying paper as a top sheet. When the coating composition is coated on an opposite side of a coated side of a bottom sheet obtained by coating a color developer, there can be obtained an intermediate sheet.

As the color developer used in a color developer sheet (an intermediate sheet or a bottom sheet) used in combination with the top sheet obtained by the present invention, there can be used conventional ones such as phenol resin compounds, salicylic acid metal salts, etc.

The coating composition can be coated on a support by using a conventional coater and dried. Examples of the coater are an air knife coater, a blade knife coater, a bar coater, a roll coater, a size press coater, etc.

As the support, there can be used acidic paper and neutral paper, both being composed mainly by cellulose fibers, synthetic paper, and the like.

This invention is illustrated by way of the following Examples, in which all parts and percents are by weight unless otherwise specified.

Example 1

A hydrophobic substance was prepared by dissolving 2 g of Crystal Violet Lactone (CVL) and 1 g of benzoyl leuco methylene blue (BLMB) in 100 g of KMC-113 (a trade name of an oil mfd. by Kureha Chemical Industry Co., Ltd.) with heating. In 100 g of a 5% aqueous solution of styrene-maleic anhdyride copolymer (Scripset 520, a trade name mfd. by Monsanto Co.) together with a small amount of sodium hydroxide and adjusted at pH 4.0, the hydrophobic substance mentioned above (an oil solution of the dye) was emulsified. To the resulting emulsion, was added a melamine-formaldehyde precondensate obtained by heating a mixture of 10 g of melamine, 25 g of 37% formalin and 65 g of water and adjusted with sodium hydroxide at pH 9, at 60° C. for 15 minutes to make the reaction solution transparent. The mixture was subjected to stirring at 60° C. for 30 minute to form micro-capsules, followed by cooling to room temperature.

To 100 parts of micro-capsules (as a solid), 35 parts of wheat starch as a buffering agent, 20 parts of SB copolymer latex (#0629, mfd. by Japan Synthetic Rubber Co., Ltd.: alkali thickening type latex, pH 8.0, Brookfield viscosity 3600 cps measured at 20° C. with a solid content of 30%, Tg −15° C.) as a binder were added to give a coating composition having a solid content of 25%. When the coating composition was diluted to 20%, pH was 8.5 and the Brookfield viscosity was 23 cps when measured at 20° C. This coating composition was continuously coated on fine paper by an air knife coating method so as to make the coating amount 40 g/m$^2$ at a rate of 80 m/sec to produce no-carbon pressure-sensitive copying paper excellent in color forming properties and resistance to smudge.

EXAMPLE 2

The process of Example 1 was repeated except for using 20 parts of SB copolymer latex L-2523 (mfd. by Asahi Kasei Kogyo Kabushiki Kaisha) which was an alkali thickening type modified copolymer latex (pH 8.0, Brookfield viscosity 4500 cps measured at 20° C. with a solid content of 30%, Tg 5° C.) in place of the binder used in Example 1 to give a coating composition having a solid content of 24%. When the coating composition was diluted to 20%, pH was 8.5 and the Brookfield viscosity was 32 cps when measured at 20° C. The coating composition was coated on a support in the same manner as described in Example 1 to produce no-carbon pressure-sensitive copolymer paper excellent in color forming properties and resistance to smudge.

Comparative Example 1

The process of Example 2 was repeated except for using 20 parts of SB copolymer latex L-2523 (mfd. by Asahi Kasei Kogyo Kabushiki Kaisah) which was not an alkali thickening type (untreated material) in place of the SB copolymer latex L-2523 modified one to give a coating composition having a solid content of 24%. When the coating composition was diluted to 20%, pH was 8.0 and the Brookfield viscosity was 9 cps when measured at 20° C. The coating composition was coated on a support in the same manner as described in Example 1 to produce no-carbon pressure-sensitive copying paper.

The resulting no-carbon pressure-sensitive copying paper was very poor in resistance to smudge due to friction in contact with a bottom sheet and the whole surface of the bottom sheet was readily colored during usage, which resulted in loosing a commercial value.

EXAMPLE 3

To 100 parts of micro-capsules obtained in the same manner as described in Example 1, 35 parts of wheat starch as a buffering agent, and 20 parts of acrylic ester copolymer latex (an alkali thickening type latex, pH 8.0, Brookfield viscosity 110 cps when measured at 20° C. with a solid content of 30%, Tg −29° C.) as a binder to give a coating composition having a solid content of 25%. When the coating composition was diluted to 20%, pH was 8.5 and the Brookfield viscosity was 22 cps when measured at 20° C. The coating composition was continuously coated on fine paper by an air knife coating method so as to make the coating amount 40 g/m$^2$ at a rate of 80 m/sec to produce no-carbon pressure-sensitive copying paper excellent in color forming properties and resistance to smudge.

EXAMPLE 4

The process of Example 3 was repeated except for using 20 parts of methyl methacrylate-butadiene copolymer latex which was an alkali thickening type modified copolymer latex (pH 8.0, Brookfield viscosity 4500 cps measured at 20° C. with a solid content of 30%, Tg 5° C.) in place of the binder used in Example 3 to give a coating composition having a solid content of 24%. When the coating composition was diluted to 20%, pH was 8.5 and the Brookfield viscosity was 32 cps when measured at 20° C. The coating composition was coated on a support in the same manner as described in Example 3 to produce no-carbon pressure-sensitive copying paper excellent in color forming properties and resistance to smudge.

EXAMPLE 5

The process of Example 3 was repeated except for using 20 parts of acrylonitrile-butadiene copolymer latex which was an alkali thickening type modified copolymer latex (pH 8.0, Brookfield viscosity 6000 cps measured at 20° C. with a solid content of 30%, Tg 5° C.) in place of the binder used in Example 3 to give a coating composition having a solid content of 24%. When the coating composition was diluted to 20%, pH was 8.5 and the Brookfield viscosity was 40 cps when measured at 20° C. The coating composition was coated on a support in the same manner as described in Example 3 to produce no-carbon pressure-sensitive copying paper excellent in color forming properties and resistance to smudge.

COMPARATIVE EXAMPLE 2

The process of Example 3 was repeated except for using 20 parts of an acrylic ester copolymer latex (Nipol 852, a trade name, mfd. by The Japanese Geon Co., Ltd., non-alkali thickening type, pH 8.0, Brookfield viscosity 3 cps measured at 20° C. with a solid content of 30%, Tg −27° C.) in place of the binder used in Example 3 to give a coating composition having a solid content of 25%. When the coating composition was diluted to 20%, pH was 8.5 and the Brookfield viscosity was 8 cps when measured at 20° C.

COMPARATIVE EXAMPLE 3

The process of Example 4 was repeated except for using 20 parts of non-alkali thickening type methyl methacrylate-butadiene copolymer latex (pH 8.0, Brookfield viscosity 7 cps measured at 20° C. with a solid content of 30% , Tg 5° C.) in place of the binder used in Example 4 to give a coating composition. When the coating composition was diluted to 20%, pH was 8.5 and the Brookfied viscosity was 8.5 cps measured at 20° C.

COMPARATIVE EXAMPLE 4

The process of Example 5 was repeated except for using 20 parts of non-alkali thickening type acrylonitrile-butadiene copolymer latex (pH 8.0, Brookfield viscosity 5 cps measured at 20° C. with a solid content of 30%, Tg 5° C.) in place of the binder used in Example 5 to give a coating composition. When the coating composition was diluted to 20%, pH was 8.5 and the Brookfield viscosity was 8 cps measured at 20° C.

Each coating composition obtained in Comparative Examples 2, 3 and 4 was coated on fine paper using an air knife coater in the same manner as described in Example 3 to produce no-carbon pressure-sensitive copying paper.

The resulting no-carbon pressure-sensitive copying papers obtained in Comparative Examples 2, 3 and 4 were compared with those of Examples 3 to 5 with the results that the formers were very poor in resistance to smudge due to friction in contact with bottom sheets and the whole surfaces of the bottom sheets were readily colored during usage, which resulted in loosing a commercial value.

As is clear from the above-mentioned Examples and Comparative Examples, by using the special alkali thickening type copolymer latex as a binder in the coating composition for no-carbon pressure-sensitive copying paper, the resulting no-carbon pressure-sensitive copying paper is excellent in color forming properties, resistance to smudge and high concentration coating suitability.

What is claimed is:

1. A no-carbon pressure-sensitive copying paper comprising a support and coated thereon a coating composition comprising (a) micro-capsules including one or more color forming agents therein, (b) a buffering agent, and (c) a binder, said binder being an alkali thickening copolymer latex.

2. A no-carbon pressure-sensitive copying paper according to claim 1, wherein the copolymer latex is an alkali thickening styrene-butadiene copolymer latex.

3. A no-carbon pressure-sensitive copying paper according to claim 2, wherein the styrene-butadiene copolymer has a glass transition temperature (Tg) of −30° C. to 10° C.

4. A no-carbon pressure-sensitive copying paper according to claim 1, wherein the copolymer latex is at least one member selected from the group consisting of an alkali thickening acrylonitrile-butadiene copolymer latex, an alkali thickening methyl methacrylate-butadiene copolymer latex, and an alkali thickening acrylic ester copolymer latex.

5. A no-carbon pressure-sensitive copying paper according to claim 4, wherein the copolymer in the latex has a glass transition temperature (Tg) of −30° C. to 10° C.

6. A no-carbon pressure-sensitive copying paper according to claim 4, wherein the copolymer latex has a Brookfield viscosity of 50 to 10000 cps when measured at 20° C. with a solid content of 30% by weight and pH of 8.0.

* * * * *